US010233663B1

(12) United States Patent
Grupp

(10) Patent No.: US 10,233,663 B1
(45) Date of Patent: Mar. 19, 2019

(54) GRAVE SITE MEMORIAL ASSEMBLY

(71) Applicant: William Grupp, Pittsburgh, PA (US)

(72) Inventor: William Grupp, Pittsburgh, PA (US)

( * ) Notice: Subject to any disclaimer, the term of this patent is extended or adjusted under 35 U.S.C. 154(b) by 0 days.

(21) Appl. No.: 15/898,263

(22) Filed: Feb. 16, 2018

(51) Int. Cl.
*E04H 13/00* (2006.01)
*G09F 7/08* (2006.01)

(52) U.S. Cl.
CPC ..... *E04H 13/003* (2013.01); *G09F 7/08* (2013.01)

(58) Field of Classification Search
CPC ..... E04H 13/003; G09F 7/08
See application file for complete search history.

(56) References Cited

U.S. PATENT DOCUMENTS 4,304,076 A * 12/1981 Splendora ..... E04H 13/003 241/DIG. 37
4,455,772 A 1/1984 Miller
5,546,710 A * 8/1996 Barry ..... E04H 13/003 52/104
5,687,515 A * 11/1997 Rodrigues ..... E04H 13/003 40/124.5
5,732,515 A 3/1998 Rodrigues
6,105,288 A 8/2000 Becker
6,132,054 A * 10/2000 Rogers ..... E04H 13/003 362/145
6,414,663 B1 * 7/2002 Manross, Jr. ..... A61G 17/08 345/87
6,463,703 B1 * 10/2002 Mattis ..... E04H 13/003 52/103
6,980,107 B1 * 12/2005 Ziegler ..... E04H 13/003 340/540
8,068,035 B1 * 11/2011 Salcedo ..... E04H 13/003 320/101
9,175,495 B1 11/2015 Bruyn
2003/0133294 A1 * 7/2003 Sittner ..... A47G 33/06 362/253
2004/0085337 A1 * 5/2004 Barrows ..... E04H 13/003 715/717
2005/0257444 A1 11/2005 Timms
2008/0229679 A1 * 9/2008 Trail ..... E04H 13/003 52/103
2008/0239714 A1 * 10/2008 Boettcher ..... A47G 29/122 362/183
2009/0320337 A1 12/2009 Biondan
2010/0307037 A1 * 12/2010 Chi ..... E04H 13/003 40/124.5
2017/0041584 A1 * 2/2017 Jones ..... G06K 7/1413
2018/0010356 A1 * 1/2018 Faulkner ..... A47G 1/12

* cited by examiner

*Primary Examiner* — Gary C Hoge

(57) ABSTRACT

A grave site memorial assembly for housing an electronic display includes a base that has a lower surface. The lower surface is configured to couple to a tombstone. A fastener is coupled to an upper surface of the base and is configured to selectively couple to a display to position the display perpendicularly to the base. A housing that defines an interior space is configured to selectively couple to the base. The housing has a bottom that is open. The bottom is configured to insert the display to position the housing to couple to the base to sealably enclose the display in the interior space. An aperture is positioned in a front of the housing. A panel is coupled to the housing to cover the aperture. The panel is transparent so that the display is positioned to be viewed by persons proximate to the housing.

17 Claims, 5 Drawing Sheets

GRAVE SITE MEMORIAL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to memorial assemblies and more particularly pertains to a new memorial assembly for housing an electronic display.

BRIEF SUMMARY OF THE INVENTION

An embodiment of the disclosure meets the needs presented above by generally comprising a base that has a lower surface. The lower surface is configured to couple to a tombstone. A fastener is coupled to an upper surface of the base and is configured to selectively couple to a display to position the display perpendicularly to the base. A housing that defines an interior space is configured to selectively couple to the base. The housing has a bottom that is open. The bottom is configured to insert the display to position the housing to couple to the base to sealably enclose the display in the interior space. An aperture is positioned in a front of the housing. A panel is coupled to the housing to cover the aperture. The panel is transparent so that the display is positioned to be viewed by persons proximate to the housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
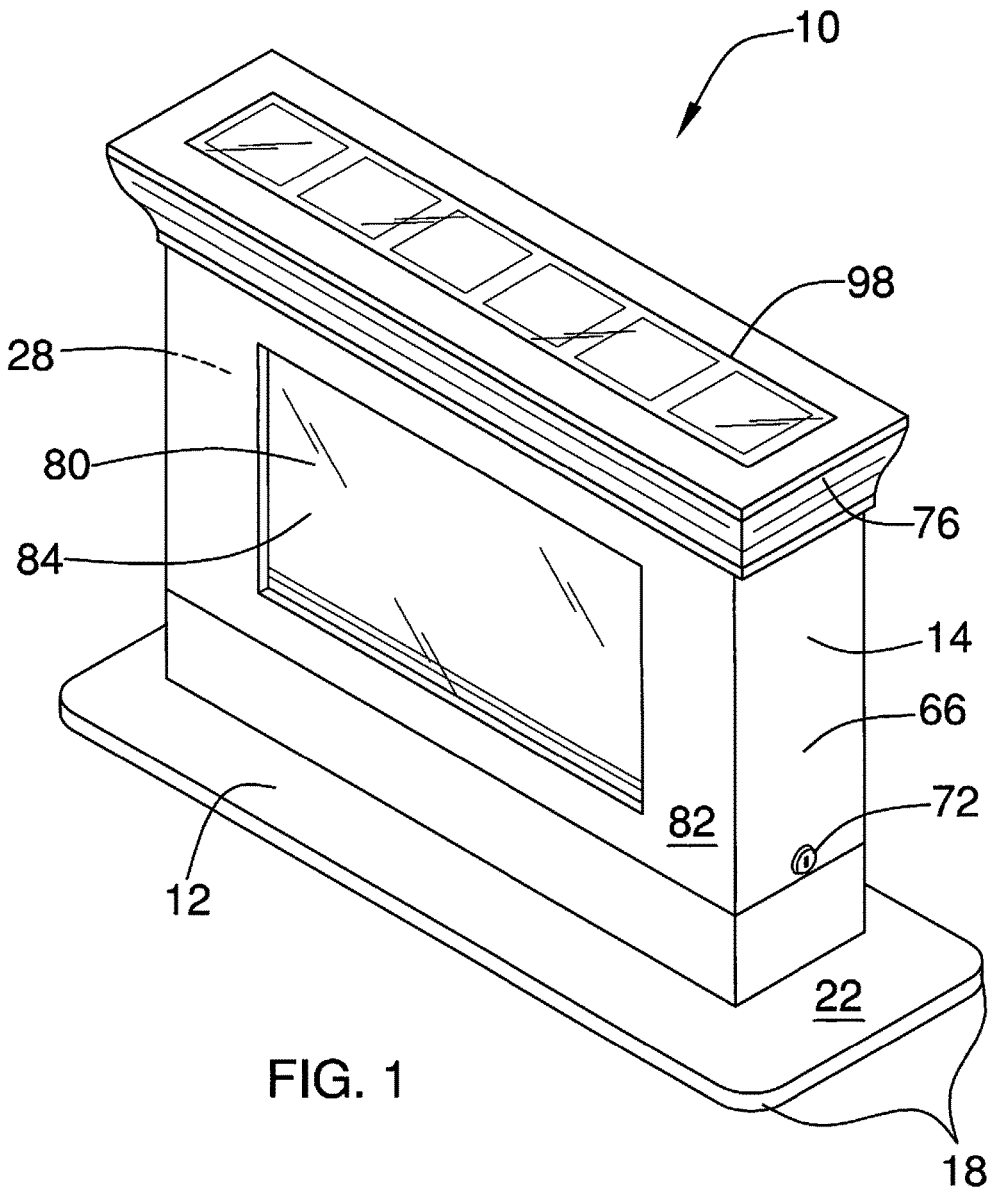
FIG. 1 is an isometric perspective view of a grave site memorial assembly according to an embodiment of the disclosure.

With reference now to the drawings, and in particular to FIGS. 1 through 5 thereof, a new memorial assembly embodying the principles and concepts of an embodiment of the disclosure and generally designated by the reference numeral 10 will be described.

As best illustrated in FIGS. 1 through 5, the grave site memorial assembly 10 generally comprises a base 12 and a housing 14. The base 12 has a lower surface 16 that is configured to couple to a tombstone. The lower surface 16 is configured to adhesively couple to the tombstone. The present invention also anticipates the base 12 being configured to be bolted to the tombstone. The base 12 is substantially rectangularly shaped. The base 12 has corners 18 that are arcuate.

A fastener 20 is coupled to an upper surface 22 of the base 12. The fastener 20 is configured to selectively couple to a display so that the display is positioned perpendicularly to the base 12. The display would be selected by the user and includes tablet style computers, netbooks, and the like. The display is loaded by the user with information, such as pictures, videos, and the like, about the person being memorialized.

Figure 2:
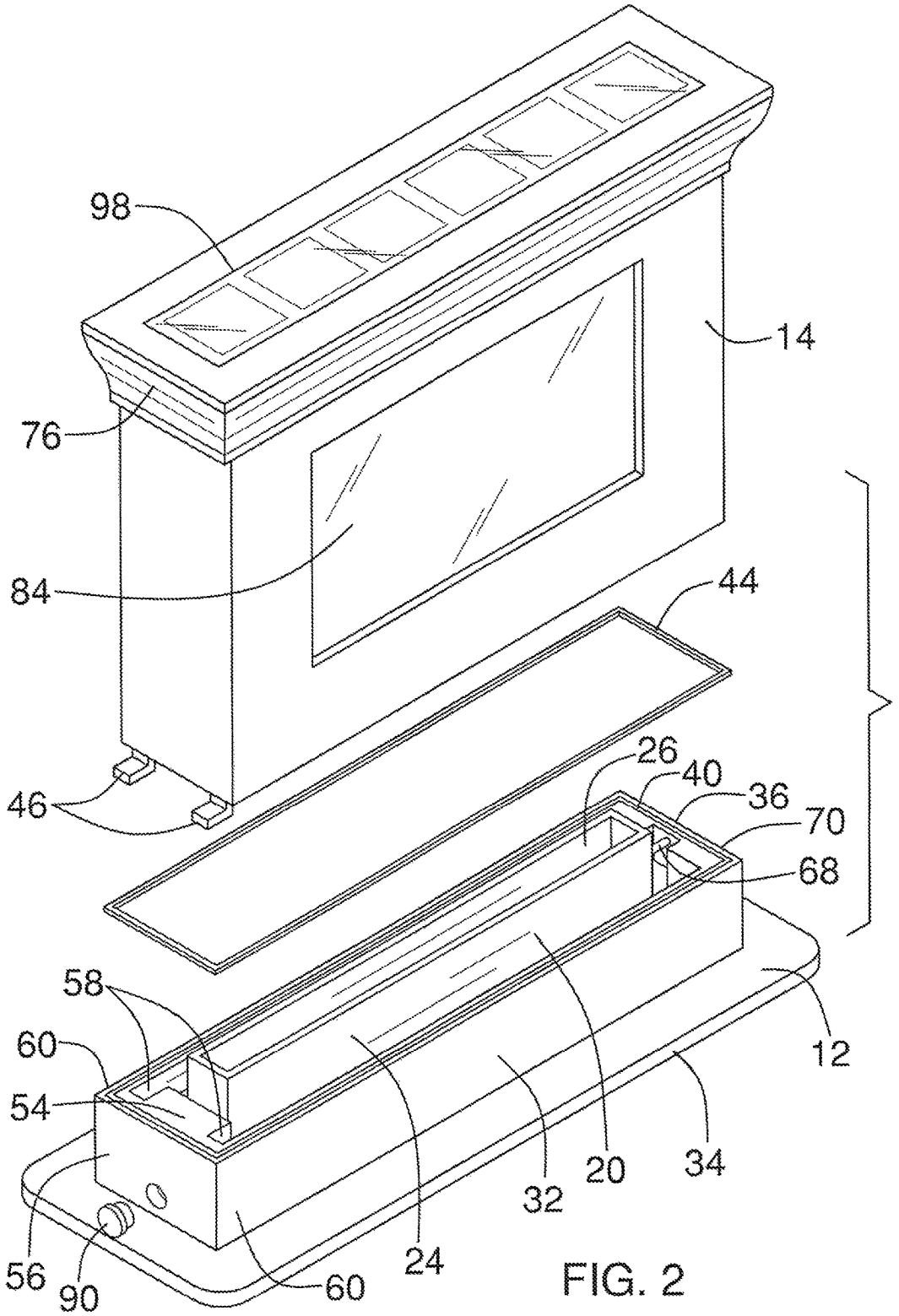
FIG. 2 is an exploded view of an embodiment of the disclosure.

The fastener 20 comprises an inner wall 24 that is coupled to and extends perpendicularly from the base 12, as shown in FIG. 2. The inner wall 24 is annular and defines a first slot 26 that is rectangularly shaped. The first slot 26 is complementary to an edge of the display so that the first slot 26 is configured to insert the edge of the display to couple the display to the base 12.

The housing 14 defines an interior space 28 and is configured to selectively couple to the base 12. The housing 14 has a bottom 30 that is open. The bottom 30 is configured to insert the display to position the housing 14 to couple to the base 12 to sealably enclose the display in the interior space 28. The housing 14 is rectangularly box shaped. The present invention anticipates the housing 14 and base 12 being integral to a tombstone, urn, or the like.

An outer wall 32 is coupled to and extends perpendicularly from the base 12. The outer wall 32 is positioned between the inner wall 24 and a circumference 34 of the base 12. The outer wall 32 is annular. An upper perimeter 36 of the outer wall 32 is complementary to a lower perimeter 38 of the housing 14.

Figure 3:
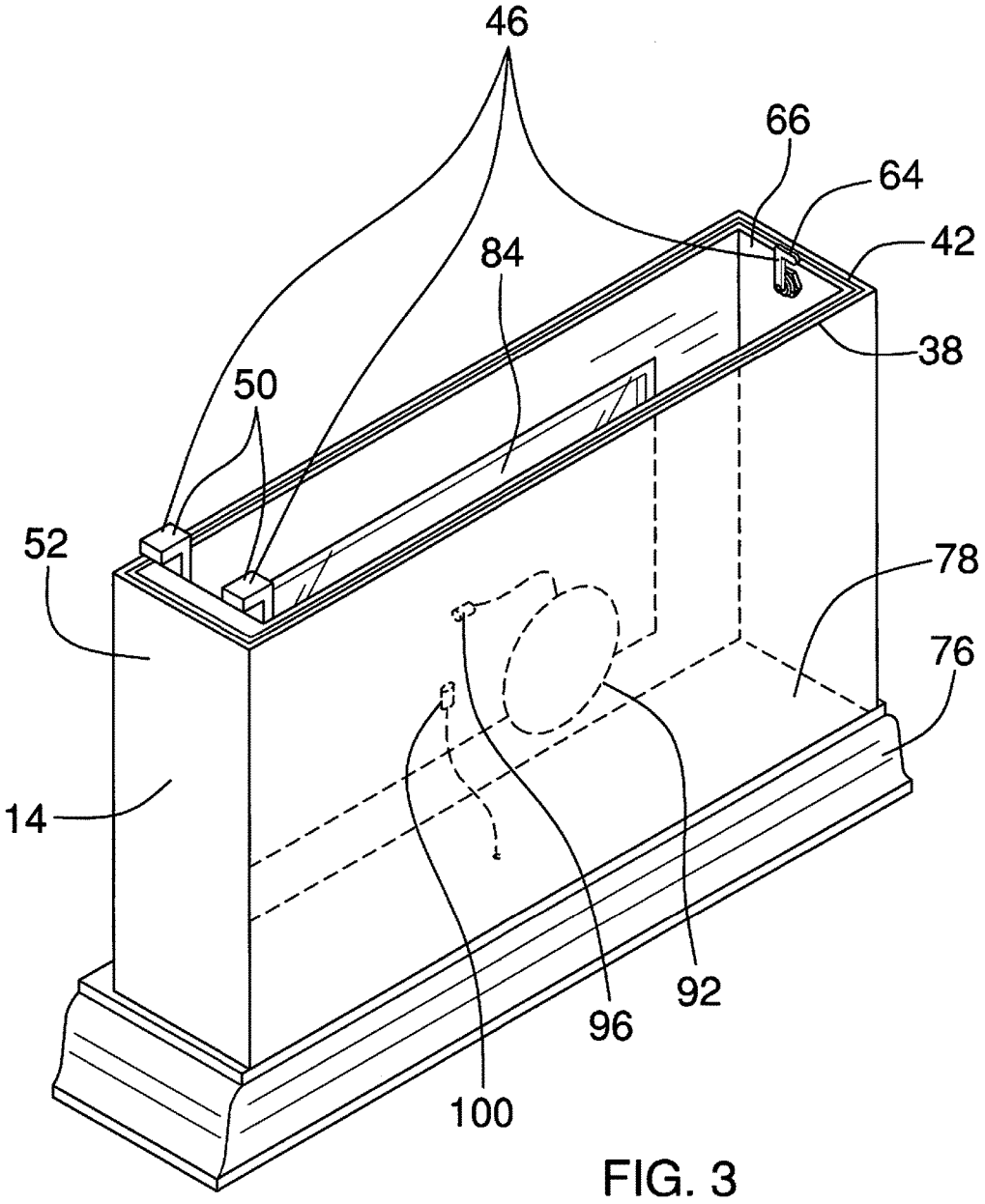
FIG. 3 is an isometric perspective view of an embodiment of the disclosure.

A first groove 40 is positioned in and extends around the upper perimeter 36 of the outer wall 32, as shown in FIG. 2. A second groove 42 is positioned in and extends around the lower perimeter 38 of the housing 14, as shown in FIG. 3. A gasket 44 is selectively positionable in the first groove 40. The gasket 44 is positioned to be inserted into the second groove 42 as the housing 14 is coupled to the outer wall 32. The gasket 44 is configured to seal the outer wall 32 to the housing 14.

A plurality of first couplers 46 is coupled to the housing 14 proximate to the lower perimeter 38. A plurality of second couplers 48 is coupled to the outer wall 32 proximate to the upper perimeter 36. The second couplers 48 are complementary to the first couplers 46. Each second coupler 48 is configured to couple to an associated first coupler 46 to couple the housing 14 to the outer wall 32.

Figure 4:
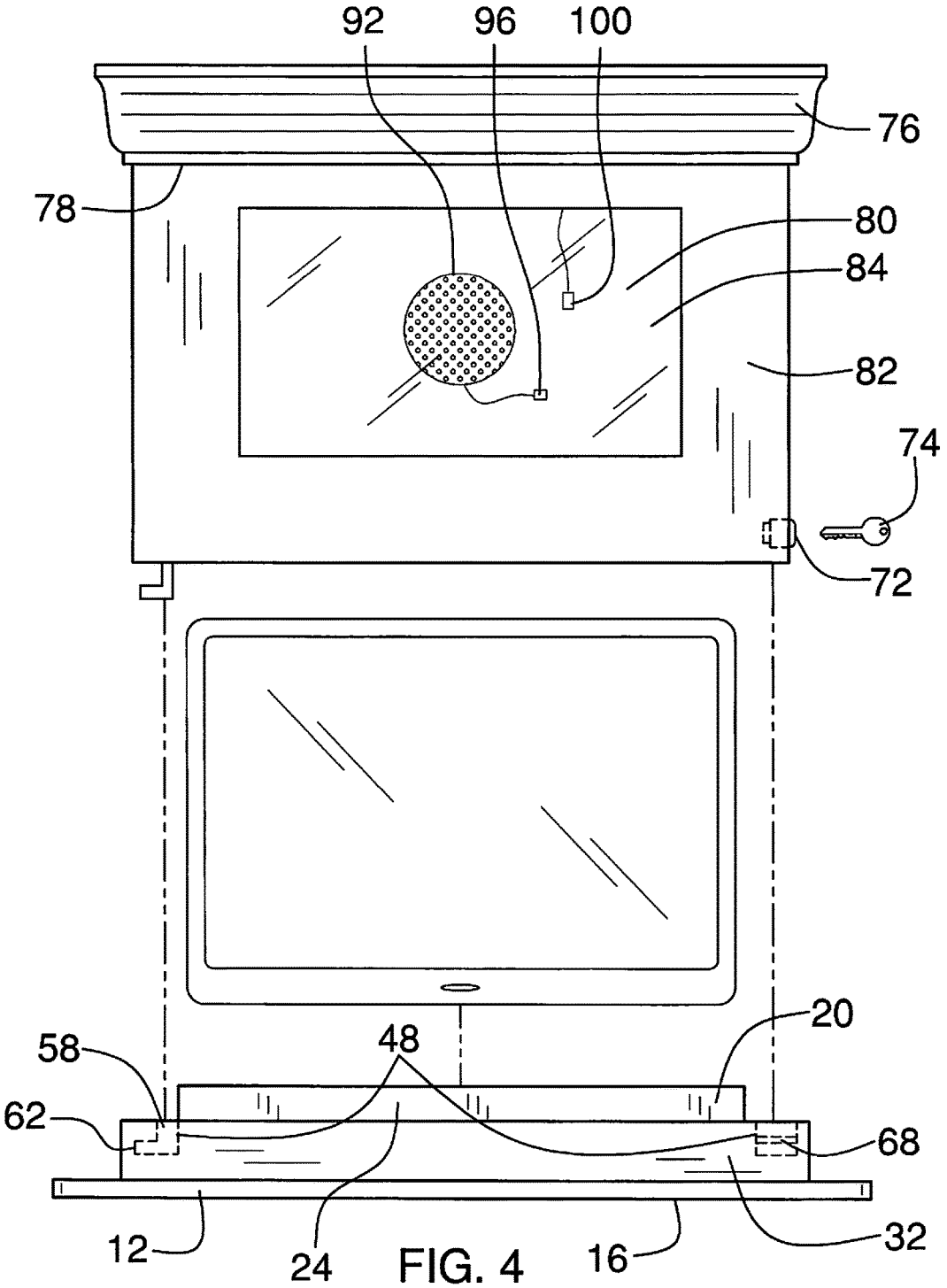
FIG. 4 is a front view of an embodiment of the disclosure.
Figure 5:
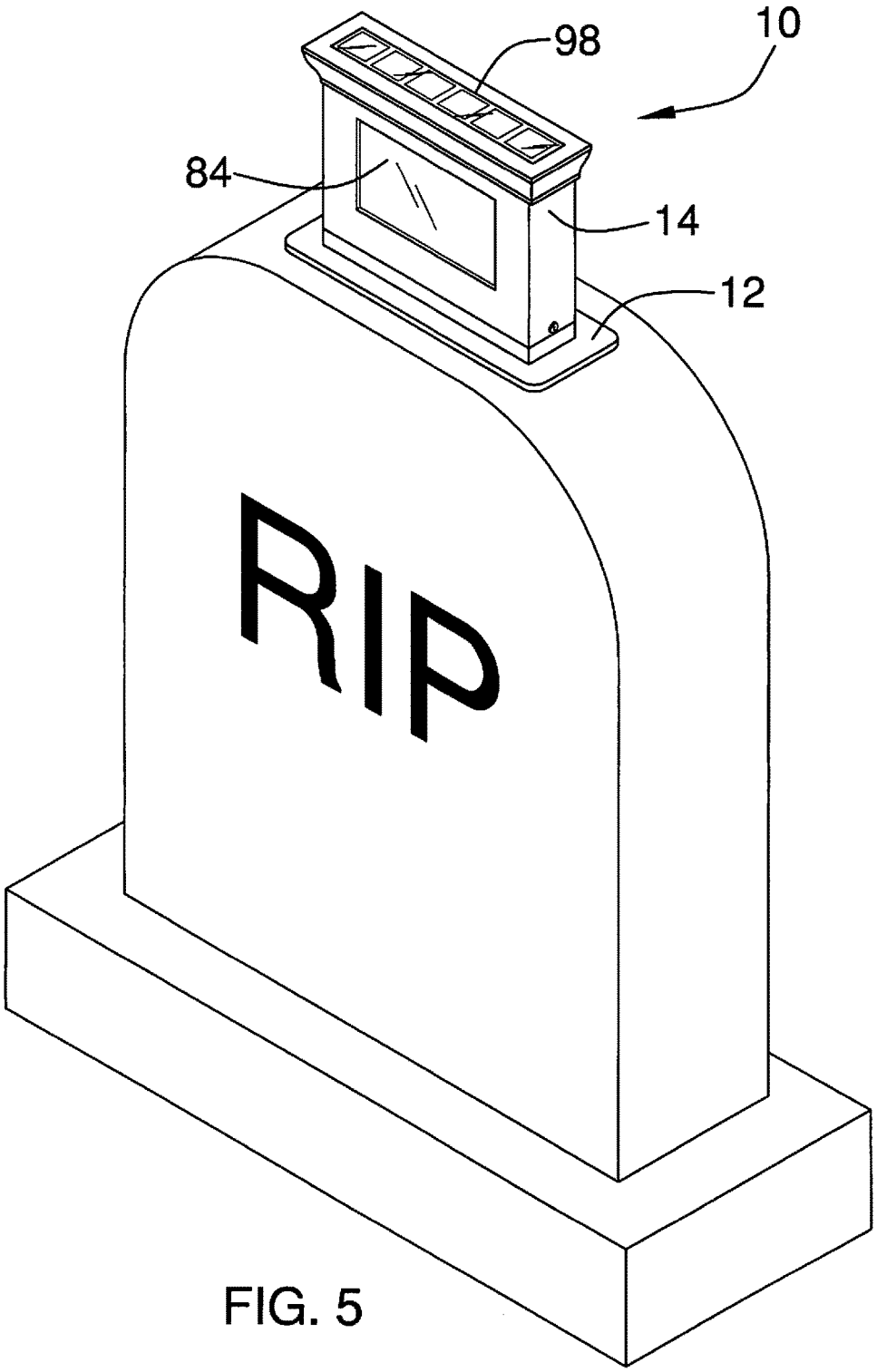
FIG. 5 is an in-use view of an embodiment of the disclosure.

The plurality of first couplers 46 comprises a pair of tabs 50 that is coupled to and extends from a first side 52 of the housing 14, as shown in FIG. 3. The plurality of second couplers 48 comprises an extrusion 54 that is coupled to and extends from a first end 56 of the outer wall 32 toward the inner wall 24. The extrusion 54 is hollow to define an internal space 86. The extrusion 54 defines a pair of second slots 58 that are positioned singly adjacent to opposing sides 60 of the outer wall 32. Each of a pair of channels 62 extends into the outer wall 32 from an associated second slot 58, as shown in FIG. 4. The channel 62 is positioned to insert an associated tab 50 as the housing 14 is positioned on the outer wall 32.

The plurality of first couplers 46 also comprises a latch 64 that is pivotally coupled to a second side 66 of the housing 14, as shown in FIG. 3. The plurality of second couplers 48 also comprises a pin 68 that is coupled to and extends between a second end 70 of the outer wall 32 and the inner wall 24, as shown in FIG. 4. The pin 68 is positioned to selectively couple with the latch 64 when the housing 14 is positioned on the outer wall 32.

A hole 88 is positioned through the first end 56 of the outer wall 32. The hole 88 extends to the internal space 86. The hole 88 is configured to allow insertion of cremated remains into the internal space 86. A plug 90, which is complementary to the hole 88, is positioned to be selectively inserted into the hole 88 to close the hole to retain the cremated remains within the internal space 86.

A lock 72 is coupled to and is positioned through the second side 66 of the housing 14. The lock 72 is operationally coupled to the latch 64. The lock 72 is positioned to selectively couple the latch 64 to the pin 68 to lock the housing 14 to the base 12. The lock 72 is tumbler-type so that the lock 72 is selectively operable with a complementary key 74.

A molding 76 is coupled to the housing 14 proximate to a top 78 of the housing 14. The molding 76 is decorative.

An aperture 80 is positioned in a front 82 of the housing 14. The aperture 80 is rectangularly shaped. The aperture 80 is sized complementarily to the display. A panel 84 is coupled to the housing 14. The panel 84 covers the aperture 80. The panel 84 is transparent so that the display is positioned to be viewed by persons proximate to the housing 14.

A speaker 92 is coupled to a back 94 of the housing 14. A first connector 96 is operationally coupled to the speaker 92. The first connector 96 is phone jack type, or the like, so that the first connector is complementary to a speaker port that is positioned on the display. The first connector 96 is configured to couple the speaker 92 to the display. The display is configured to broadcast an audio file, such as an audio file that provides details about the person being memorialized, to the persons proximate to the housing 14.

A solar panel 98 coupled to the top 78 of the housing 14. A second connector 100 is operationally coupled to the solar panel 98. The second connector 100 is micro-USB type, or the like, so that the second connector 100 is complementary to a charging port that is positioned on the display. The second connector 100 is configured to couple the solar panel 98 to the display to recharge a battery of the display.

In use, the lower surface 16 is configured to be adhesively coupled to the tombstone. The base 12 is positioned to insert the display into the first slot 26. The gasket 44 is positioned to insert into the second groove 42 as the housing 14 is coupled to the outer wall 32 to seal the outer wall 32 to the housing 14. The lock 72 is positioned to selectively couple the latch 64 to the pin 68 to lock the housing 14 to the base 12. The display is positioned to be viewed by the persons proximate to the housing 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A grave site memorial assembly comprising:

a base having a lower surface configured for coupling to a tombstone;

a fastener coupled to an upper surface of said base, said fastener being configured for selectively coupling to a display such that the display is positioned perpendicularly to said base;

a housing defining an interior space, said housing being configured for selectively coupling to said base, said housing having a bottom, said bottom being open such that said bottom is configured for inserting the display positioning said housing for coupling to said base for sealably enclosing the display in said interior space;

an aperture positioned in a front of said housing;

a panel coupled to said housing such that said panel covers said aperture, said panel being transparent; and wherein said panel is positioned in said housing such that the display is positioned for viewing by persons proximate to said housing.

2. The assembly of claim 1, further including said lower surface being configured for adhesively coupling to the tombstone.

3. The assembly of claim 1, further including said base being substantially rectangularly shaped.

4. The assembly of claim 3, further including said base having corners, said corners being arcuate.

5. The assembly of claim 1, further including said fastener comprising an inner wall coupled to and extending perpendicularly from said base, said inner wall being annular such that said inner wall defines a first slot, said first slot being rectangularly shaped such that said first slot is complementary to an edge of the display configuring said first slot for inserting the edge of the display for coupling the display to said base.

6. The assembly of claim 3, further including said housing being rectangularly box shaped.

7. The assembly of claim 6, further comprising:

an outer wall coupled to and extending perpendicularly from said base, said outer wall being positioned between said inner wall and a circumference of said base, said outer wall being annular such that an upper perimeter of said outer wall is complementary to a lower perimeter of said housing;

a first groove positioned in and extending around said upper perimeter of said outer wall;

a second groove positioned in and extending around said lower perimeter of said housing; and a gasket selectively positionable in said first groove such that said gasket is positioned for inserting into said second groove as said housing is coupled to said outer wall such that said gasket is configured for sealing said outer wall to said housing.

8. The assembly of claim 7, further comprising:

a plurality of first couplers coupled to said housing proximate to said lower perimeter;

a plurality of second couplers coupled to said outer wall proximate to said upper perimeter, said second couplers being complementary to said first couplers; and wherein said second couplers are positioned on said outer wall such that each said second coupler is configured for coupling to an associated said first coupler for coupling said housing to said outer wall.

9. The assembly of claim 8, further comprising:

said plurality of first couplers comprising:

a pair of tabs coupled to and extending from a first side of said housing, and a latch pivotally coupled to a second side of said housing;

said plurality of second couplers comprising:

an extrusion coupled to and extending from a first end of said outer wall toward said inner wall such that said extrusion defines a pair of second slots positioned singly adjacent to opposing sides of said outer wall, a pair of channels, each said channel extending into said outer wall from an associated said second slot such that said channel is positioned for inserting an associated said tab as said housing is positioned on said outer wall, and a pin coupled to and extending between a second end of said outer wall and said inner wall positioning said pin for selectively coupling with said latch when said housing is positioned on said outer wall.

10. The assembly of claim 9, further including a lock coupled to and positioned through said second side of said housing, said lock being operationally coupled to said latch, wherein said lock is positioned on said housing such that said lock is positioned for selectively coupling said latch to said pin for locking said housing to said base.

11. The assembly of claim 10, further including said lock being tumbler-type such that said lock is selectively operable with a complementary key.

12. The assembly of claim 10, further comprising:

said extrusion being hollow such that said extrusion defines an internal space;

a hole positioned through said first end of said outer wall extending to said internal space;

a plug complementary to said hole; and wherein said hole is configured for inserting cremated remains into said internal space wherein said plug is positioned for selectively inserting into said hole for closing said hole for retaining the cremated remains within said internal space.

13. The assembly of claim 1, further including a molding coupled to said housing proximate to a top of said housing.

14. The assembly of claim 1, further including said aperture being rectangularly shaped, said aperture being sized complementarily to the display.

15. The assembly of claim 1, further comprising:

a speaker coupled to a back of said housing;

a first connector operationally coupled to said speaker, said first connector being complementary to a speaker port positioned on the display; and wherein said first connector is configured for coupling said speaker to the display such that the display is configured for broadcasting an audio file to the persons proximate to said housing.

16. The assembly of claim 1, further comprising:

a solar panel coupled to a top of said housing;

a second connector operationally coupled to said solar panel, said second connector being complementary to a charging port positioned on the display; and wherein said second connector is configured for coupling said solar panel to the display such that said solar panel is configured for recharging a battery of the display.

17. A grave site memorial assembly comprising:

a base having a lower surface configured for coupling to a tombstone, said lower surface being configured for adhesively coupling to the tombstone, said base being substantially rectangularly shaped, said base having corners, said corners being arcuate;

a fastener coupled to an upper surface of said base, said fastener being configured for selectively coupling to a display such that the display is positioned perpendicularly to said base, said fastener comprising an inner wall coupled to and extending perpendicularly from said base, said inner wall being annular such that said inner wall defines a first slot, said first slot being rectangularly shaped such that said first slot is complementary to an edge of the display configuring said first slot for inserting the edge of the display for coupling the display to said base;

a housing defining an interior space, said housing being configured for selectively coupling to said base, said housing having a bottom, said bottom being open such that said bottom is configured for inserting the display positioning said housing for coupling to said base for sealably enclosing the display in said interior space, said housing being rectangularly box shaped;

an outer wall coupled to and extending perpendicularly from said base, said outer wall being positioned between said inner wall and a circumference of said base, said outer wall being annular such that an upper perimeter of said outer wall is complementary to a lower perimeter of said housing;

a first groove positioned in and extending around said upper perimeter of said outer wall;

a second groove positioned in and extending around said lower perimeter of said housing;

a gasket selectively positionable in said first groove such that said gasket is positioned for inserting into said second groove as said housing is coupled to said outer wall such that said gasket is configured for sealing said outer wall to said housing;

a plurality of first couplers coupled to said housing proximate to said lower perimeter, said plurality of first couplers comprising a pair of tabs coupled to and extending from a first side of said housing and a latch pivotally coupled to a second side of said housing;

a plurality of second couplers coupled to said outer wall proximate to said upper perimeter, said second couplers being complementary to said first couplers, wherein said second couplers are positioned on said outer wall such that each said second coupler is configured for coupling to an associated said first coupler for coupling said housing to said outer wall, said plurality of second couplers comprising:

an extrusion coupled to and extending from a first end of said outer wall toward said inner wall such that said extrusion defines a pair of second slots positioned singly adjacent to opposing sides of said outer wall, said extrusion being hollow such that said extrusion defines an internal space; a pair of channels, each said channel extending into said outer wall from an associated said second slot such that said channel is positioned for inserting an associated said tab as said housing is positioned on said outer wall, and a pin coupled to and extending between a second end of said outer wall and said inner wall positioning said pin for selectively coupling with said latch when said housing is positioned on said outer wall;

a hole positioned through said first end of said outer wall extending to said internal space;

a plug complementary to said hole wherein said hole is configured for inserting cremated remains into said internal space wherein said plug is positioned for selectively inserting into said hole for closing said hole for retaining the cremated remains within said internal space;

a lock coupled to and positioned through said second side of said housing, said lock being operationally coupled to said latch, wherein said lock is positioned on said housing such that said lock is positioned for selectively coupling said latch to said pin for locking said housing to said base, said lock being tumbler-type such that said lock is selectively operable with a complementary key;

a molding coupled to said housing proximate to a top of said housing;

an aperture positioned in a front of said housing, said aperture being rectangularly shaped, said aperture being sized complementarily to the display;

a panel coupled to said housing such that said panel covers said aperture, said panel being transparent, wherein said panel is positioned in said housing such that the display is positioned for viewing by persons proximate to said housing;

a speaker coupled to a back of said housing;

a first connector operationally coupled to said speaker, said first connector being complementary to a speaker port positioned on the display wherein said first connector is configured for coupling said speaker to the display such that the display is configured for broadcasting an audio file to the persons proximate to said housing;

a solar panel coupled to said top of said housing;

a second connector operationally coupled to said solar panel, said second connector being complementary to a charging port positioned on the display wherein said second connector is configured for coupling said solar panel to the display such that said solar panel is configured for recharging a battery of the display; and wherein said lower surface is configured for adhesively coupling to the tombstone positioning said base for inserting the display into said first slot, wherein said gasket is positioned for inserting into said second groove as said housing is coupled to said outer wall such that said gasket is configured for sealing said outer wall to said housing, wherein said lock is positioned on said housing such that said lock is positioned for selectively coupling said latch to said pin for locking said housing to said base, wherein said panel is positioned in said housing such that the display is positioned for viewing by the persons proximate to said housing.

* * * * *